US006393797B1

(12) United States Patent
Romes

(10) Patent No.: US 6,393,797 B1
(45) Date of Patent: May 28, 2002

(54) ROLLED FABRIC DISPENSING METHOD

(75) Inventor: Gary E. Romes, Cincinnati, OH (US)

(73) Assignee: Guardian Fiberglass, Inc., Albion, MI (US)

( * ) Notice: Subject to any disclaimer, the term of this patent is extended or adjusted under 35 U.S.C. 154(b) by 0 days.

(21) Appl. No.: 09/511,306

(22) Filed: Feb. 23, 2000

(51) Int. Cl.[7] ..... E04B 1/00; E04G 21/00

(52) U.S. Cl. ..... 52/746.1; 52/746.11; 52/749.12; 52/745.06; 52/745.13; 242/566; 242/590

(58) Field of Search ..... 52/746.11, 746.1, 52/749.1, 749.12, 745.06, 745.13; 242/566, 594.6, 615.4

(56) References Cited

U.S. PATENT DOCUMENTS 4,967,535 A * 11/1990 Alderman ..... 52/749
5,491,952 A * 2/1996 Alderman et al. ..... 52/749.12
5,561,959 A 10/1996 Alderman et al.
5,653,081 A * 8/1997 Wenrick et al. ..... 52/742.12
5,720,147 A * 2/1998 Wenrick et al. ..... 52/745.06
5,921,057 A * 7/1999 Alderman et al. ..... 52/746.11

FOREIGN PATENT DOCUMENTS

| | | |
|---|---|---|
| EP | 0778377 | 6/1977 |
| EP | 0018006 | 4/1980 |
| WO | 9909271 | 2/1999 |

OTHER PUBLICATIONS

EP Search Report 00126471, Sep. 21, 2001.

* cited by examiner

*Primary Examiner*—Beth A. Stephan
*Assistant Examiner*—Patrick J. Chavez
(74) *Attorney, Agent, or Firm*—Hall, Priddy, Myers & Vande Sande

(57) ABSTRACT

An insulated roof or wall structure is formed by creating a depth of drape to the approximate thickness of the R-value of a fiberglass insulation batt in a draped, untaut sheet of vapor barrier material which defines an insulation cavity in which the fiberglass is located thereby minimizing compression of the fiberglass and approximating in the structure its intended R-value.

12 Claims, 7 Drawing Sheets

Fig.10
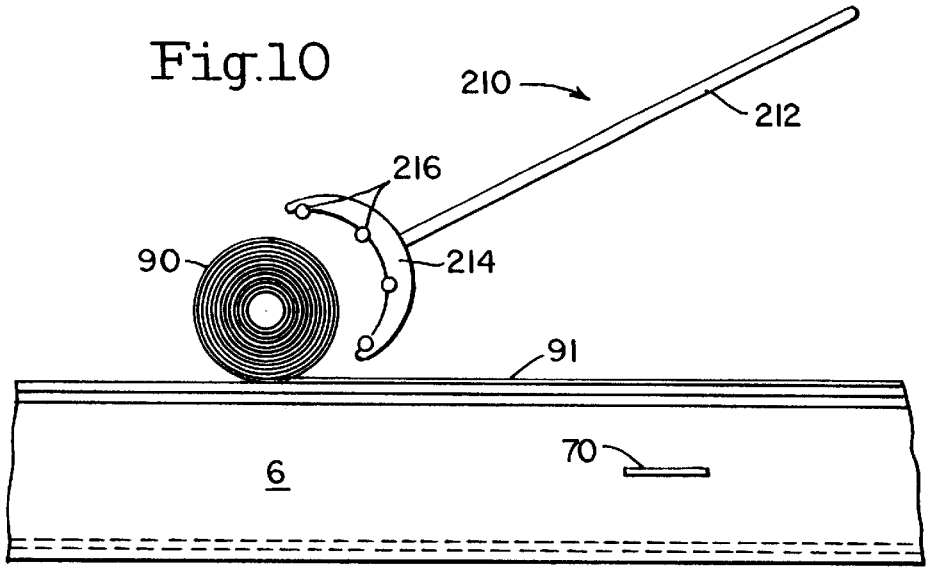
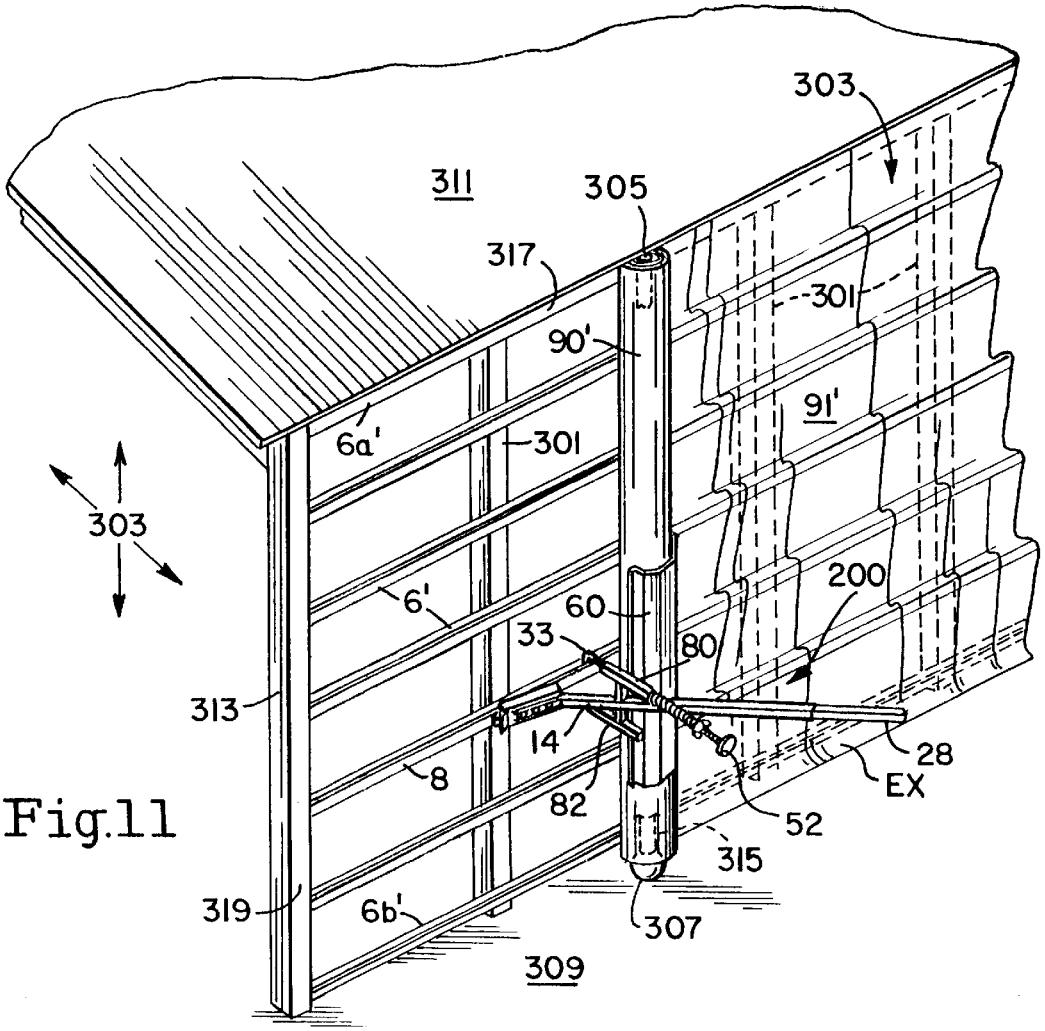
Fig.11

ROLLED FABRIC DISPENSING METHOD

FIELD OF THE INVENTION

This invention relates to methods for dispensing rolled fabric on a building structure. More particularly, this invention relates to methods for dispensing a rolled fabric across the width of at least two longitudinal structural supports (e.g. purlins or girts) of a metal building structure.

BACKGROUND OF THE INVENTION

Metal roof structures are typically comprised of a series of rafters which extend parallel to each other from one side of a building to another. Longitudinal structural supports (referred to as girts, purlins or bar joists, herein used interchangeably) are typically mounted on top of and perpendicular to these rafters in a similarly parallel fashion. In like fashion, the walls of a building may be comprised of a series of vertical studs or columns on which the aforesaid girts are mounted in a horizontal fashion (perpendicular to the studs or columns).

In one known manner of fabricating such conventional metal roof and wall structures, a rolled fabric (e.g. polyethylene) is first rolled out in sheet form over the structural supports before installing the fiberglass insulation batting in order to serve as a vapor barrier (a.k.a. "retarder") for the roof or wall system. The sheets are usually placed in an overlapping edge arrangement so as to be sure to form a continuous vapor barrier. Insulation usually in the form of rolled out fiberglass insulation batting is then installed over the sheet(s) of fabric. The insulation is secured in place by placing over it hard (typically metal) sheeting called roof sheeting. These hard sheets are then attached with roofing (or wall) panel fasteners (screws, for example) which ultimately hold the fabric and insulation in place against the upper surface of the flange of the purlins.

Heretofore, it has been known in the art to install such rolled fabric across the top of purlins by hand or by various carriage devices, in a substantially taut manner, such as described in U.S. Pat. Nos. 4,635,423 and 4,736,552. Utilizing such a taut sheet when building an insulated roof or wall structure gave rise to a drawback in prior art systems which inherently reduced the R-value of the insulation in the final roof system. For example, in certain conventional installation techniques heretofore used in the art, when the metal sheeting was attached to the upper surface of the purlins and the metal sheeting secured, the sheeting compressed the insulation between this sheeting and the sheet of fabric which has been pulled tight and secured by the sheeting fasteners. Thus, the insulation, normally a fiberglass batt of a specified thickness to achieve the required R-value, could not recover to its original thickness, resulting in a loss of R-value, often significantly below its intended value.

One known system which attempts to overcome this compression problem is disclosed in U.S. Pat. No. 5,653,081. In this system, a pleat system is pre-manufactured into a sheet of rolled fabric. When the fabric is the installed (unrolled) parallel, but overlapping the purlins, the pleats unfold into the insulation cavity, which may be defined as the volume or space between any two adjacent purlins and the depth of the pleat. When an elongated batt of insulation is laid parallel to the purlins, the batt if appropriately made to have a width equal to that of the space between the two adjacent purlins, is able to occupy the insulation cavity created by the unfolding of the pleats. In theory, by selecting an appropriate combination of pleat number and size which corresponds to each given R-value (as governed by the thickness of the insulation batt), a depth of draped cavity may be achieved in the fabric which overcomes the compression problem. Ideally, a pleat number and size will be manufactured into the fabric sufficient to create a draped cavity of depth "x" or slightly more, which will then match a batt of thickness "x" corresponding to a desired R-value. Opposing pleats which form an insulation cavity, must also, of course, be manufactured to a spaced distance similar to the spacing between purlins . . . spacing which may vary from building type to building type.

In such a system, therefore, the desired number and size of pleats necessary to achieve a depth of draped insulation cavity corresponding to any given R-value must be pre-manufactured at significant expense into a fabric itself for each R-value and purlin width anticipated for use. The use of different R-values is prevalent in commerce, and as stated aforesaid, purlin spacing is not always a standard distance. Not only does this then create inventory problems, but, of course, it is also not possible to select an insulation thickness or R-value on site once a particular roll of sheeting is delivered without having to delay construction until rolls of fabric having the requisite pleat dimensions are delivered. Moreover, if too small a pleat size is delivered to the job site or inadvertently (or knowingly, to save time) loaded on a dispensing device and installed as part of the roof system, a significant reduction in the agreed to R-value may well occur.

In view of the above, it is apparent that there exists a need in the art for a rolled fabric dispensing method which overcomes the above drawbacks. It is a purpose of this invention to fulfill this need in the art, as well as other needs which will become apparent to the skilled artisan once given the following disclosure.

SUMMARY OF THE INVENTION

Generally speaking, this invention fulfills the above-described needs in the art by providing in the method of constructing an insulated roof or wall system which includes a pair of spaced, substantially parallel structural members comprised of a longitudinal surface for receiving thereon a sheet of vapor barrier material, the steps comprising applying a sheet of vapor barrier material across said pair of structural members, applying a layer of compressible and recoverable insulation having a predetermined thickness which at least in part determines the R-value of the insulation over the sheet of vapor barrier material, and applying a cover material overlying the layer of insulation, the improvement comprising the steps of:

a) overlaying the longitudinal surfaces of the pair of opposing structural members with an untaut sheet of vapor barrier material having an untaut width sufficient to allow the formation therewith of an insulation cavity between the pair of structural members to a depth of drape sufficient such that when the insulation layer resides in the cavity, a portion of the insulation has a thickness approximately equal to the said predetermined thickness;

b) overlaying the untaut sheet of vapor barrier material with a layer of said insulation;

c) forming the insulation cavity to said depth of drape wherein a substantial portion of the insulation is located in the cavity;

d) overlaying the insulation with a covering material; and f) forming a structurally integrated roof or wall system by securing the vapor barrier sheet, the insulation and the covering material to each other and to the structural members, whereby a substantial portion of said insulation in said cavity has a thickness approximately equal to said predetermined thickness.

In one embodiment of this invention a single roll of vapor barrier fabric extends across the entire span of the roof or wall being covered. In other embodiments, multiple, adjacent short rolls of the fabric are used to create an overlapping sheet arrangement which spans the surface of the wall or roof in a staggered array so that excess fabric does not extend into the building. In such an embodiment the method includes unrolling a first leading roll of fabric a given distance, unrolling a second roll of fabric located adjacent the first roll a distance which is less than the distance traveled by the first roll thereby to create a trailing roll of the second roll with respect to the first roll.

This invention will now be described with respect to certain embodiments thereof as illustrated in the accompanying drawings wherein:

IN THE DRAWINGS

FIG. 10 is a side view of a roll adjuster useful in the practice of this invention.

FIG. 11 is a three dimensional side view of a vertical wall structure being constructed according to this invention.

DETAILED DESCRIPTION OF CERTAIN EMBODIMENTS

Figures 1, 4:
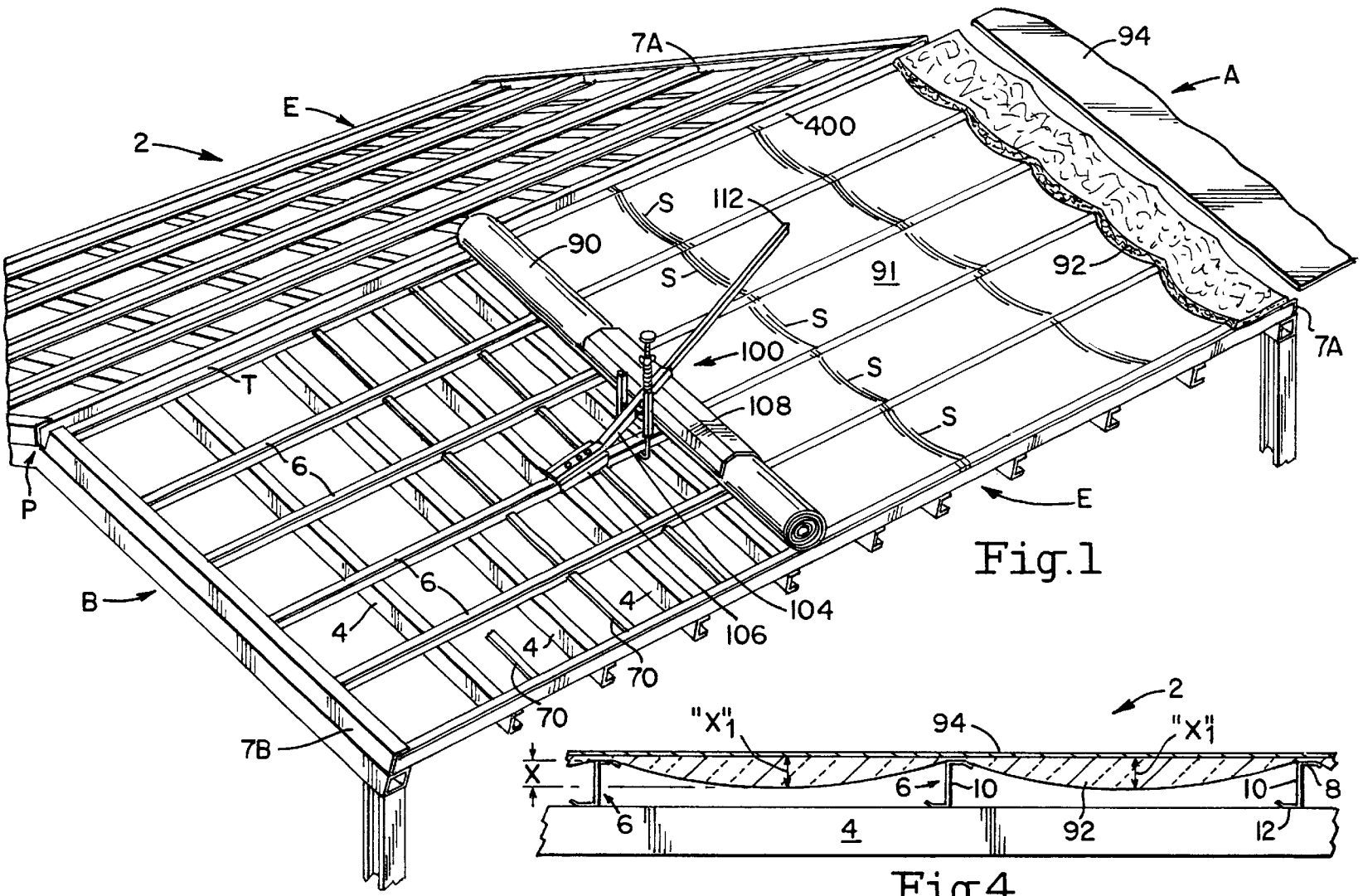
FIG. 1 is a partially exploded, three dimensional view of a metal building roof structure in the process of having an insulated roof system installed thereon according to this invention.
FIG. 4 is a semi-schematic side sectional view demonstrating a "depth of drape".

Referring initially to FIG. 1, a typical known roof structure 2 is illustrated. Structure 2 includes rafters 4 fixed in a spaced parallel arrangement, each rafter extending laterally across roof 2 from a first end at the roof's eave "E" to the roof's peak "P". Further included in the roof's structure are purlins 6 (or bar joists) fixedly attached on top of and perpendicular to rafters 4. Cross members 70 are also normally included to further support the roof structure.

FIG. 1 illustrates for demonstrative purposes a roof 4 having numerous rafters 4 and a large number of reasonably closely spaced purlins 6 and cross members 70. Other known roof structures often include less rafters, purlins, and cross members with not every space between purlin pairs having a cross member therein. The nature and advantages of this invention are that this invention is widely applicable to virtually all such structures except perhaps for the most bizarre and unusual of spacing, a fact which will become apparent to the skilled artisan from the description of this invention as set forth hereinafter. Generally speaking, in this respect a typical spacing found in many buildings between rafters 4, centerline to centerline, is approximately 25 feet. Purlin spacing, centerline to centerline varies but may typically be about five feet.

Figure 3:
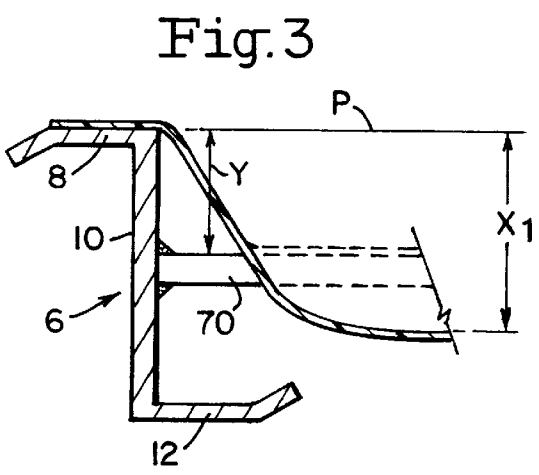
FIG. 3 is a partial side sectional view taken along section line 3—3 of FIG. 2.
Figure 2:
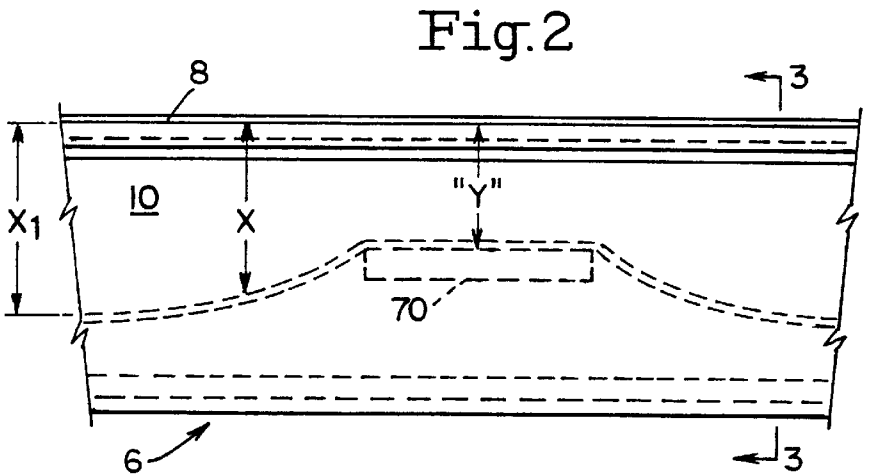
FIG. 2 is a partial, front plan view of a purlin/cross member system having draped thereon a fabric according to this invention.

Purlins are normally parallel to the other (FIG. 1) and typically have a "Z" shaped configuration (see also FIG. 3) comprised of an upper flange 8 and a lower flange 12 each extending at right angles, but in opposite directions from the respective top and bottom edges of intermediate web portion 10. Cross members 70 are attached at their ends to opposing web portions 10 within a pair of opposing purlins 6. With reference to FIGS. 2–3 the location of a cross member with respect to web portion 10 may be designated by the distance "y" from the top surface of flange 8 to the top surface of cross member 70, i.e. the top surface of purlin 6 on which fabric 91 will reside, and the top surface of cross member 70 on which fabric 91 may reside if located higher rather than lower on web 10. Distance "y" varies in the art from design to design and even at times from purlin manufacturer to purlin manufacturer. This invention is available for use in constructing a roof system having a wide variety of distances "y", and also, of course, when no cross-member 70 is employed.

Also shown in FIG. 1 is a rolled dispensing apparatus (dispenser) 100 depicted in the process of dispensing rolled fabric 90 (e.g. high density, woven polyethylene) in a draped sheet configuration across roof structure 2. As explained further below, roll 90 has been moved farther ahead than in actual practice of the first installed fiberglass insulation batting 92 for the purposes of a better view of the process taking place (wherein in exploded view, metal roof cover sheeting 94 is in the process of being placed and thereafter secured on top of batting 92). In actual practice, as explained in more detail below, after first batt 92 is in place and sheeting 94 is secured through batt 92 and sheet 91 to flange 8 of purlins 6, dispenser 100 is only actually advanced along the purlins, in preferred practice, a little more than the width of the next batt 92 to be laid down, usually by the worker(s) standing on the first installed layer stack (i.e. the secured stack of sheet 91, first batt 92 and metal panel 94). Thereafter the next layer stack is installed, and so on until the roof system is completed. In this way, the danger of having to stand on a purlin is avoided. Moreover, in this regard, FIG. 1 shows one continuous roll 90 being used to span the entire distance from eave "E" to peak "P." This is true for smaller buildings. However, for larger buildings, multiple adjacent rolls will be used as further described below.

The principal purpose of fabric sheet 91 is to create a continuous vapor barrier across the entire roof surface. Even if multiple rolls are employed, the preferred embodiments of this invention achieve the continuous nature of this vapor barrier despite the creation of an insulating cavity using a untaut application of sheet 91 to thereby create a lateral drape or sag "S" in the sheeting between a respective opposing pair of purlins 6 to a predetermined "depth of drape" which is eventually filled with a substantial portion of batt 92, and thus which thereby minimizes the compression of batt 92 when metal sheeting 94 is laid over batt 92 and secured to the top flange 8 of purlins 6.

With reference in particular to FIGS. 2–4, the term "drape" and particularly the term "depth of drape" is exemplified. The term "drape" means the sag "S" in sheet 91 between opposing purlins 6. The term "depth of drape" as used herein is thus defined as the distance from the plane "P" defined by and extending between the top surfaces of an opposing pair of purlin flanges 8 to the top surface of the sheet 91 on which the insulation 92 also resides. This distance varies due to the nature of the generally arcuate shape of the sags "S" when formed. As shown in FIGS. 2–4, the "depth of drape" at any particular location may be represented by the distance (or dimension) "x". The maximum "depth of drape" may then be represented by "$x_1$". An "insulating cavity" as defined herein is thus represented as a volume of space confined by sheet 91 between opposing purlins 6 having a depth of drape "x" at any given point, with a maximum depth of "$x_1$".

As stated above, during installation of a roof structure, it is usually desirable and often a contractual obligation that the builder achieve, as near as is reasonably and economically feasible the predetermined R-value. Unfortunately, when compressible insulation (e.g. fiberglass or other synthetic fibrous materials) is employed, the R-value of the insulation is governed in large part by the ultimate thickness of the fibrous batt, which if compressed to a lesser thickness, looses R-value (i.e. is reduced to a lesser R-value) unless it is allowed sufficient space to recover. The present invention solves this problem by creating for a given R-value (and thus a corresponding thickness of compressible insulation batting) an intentional sage in the vapor barrier sheet to a preselected "depth of drape" as determined by its maximum depth of drape when forming sheet 91 from roll 90.

In contrast to certain prior art solutions discussed above, this invention is simple, economical, and does not require specially manufactured sheeting with pleats etc.

Figure 5:
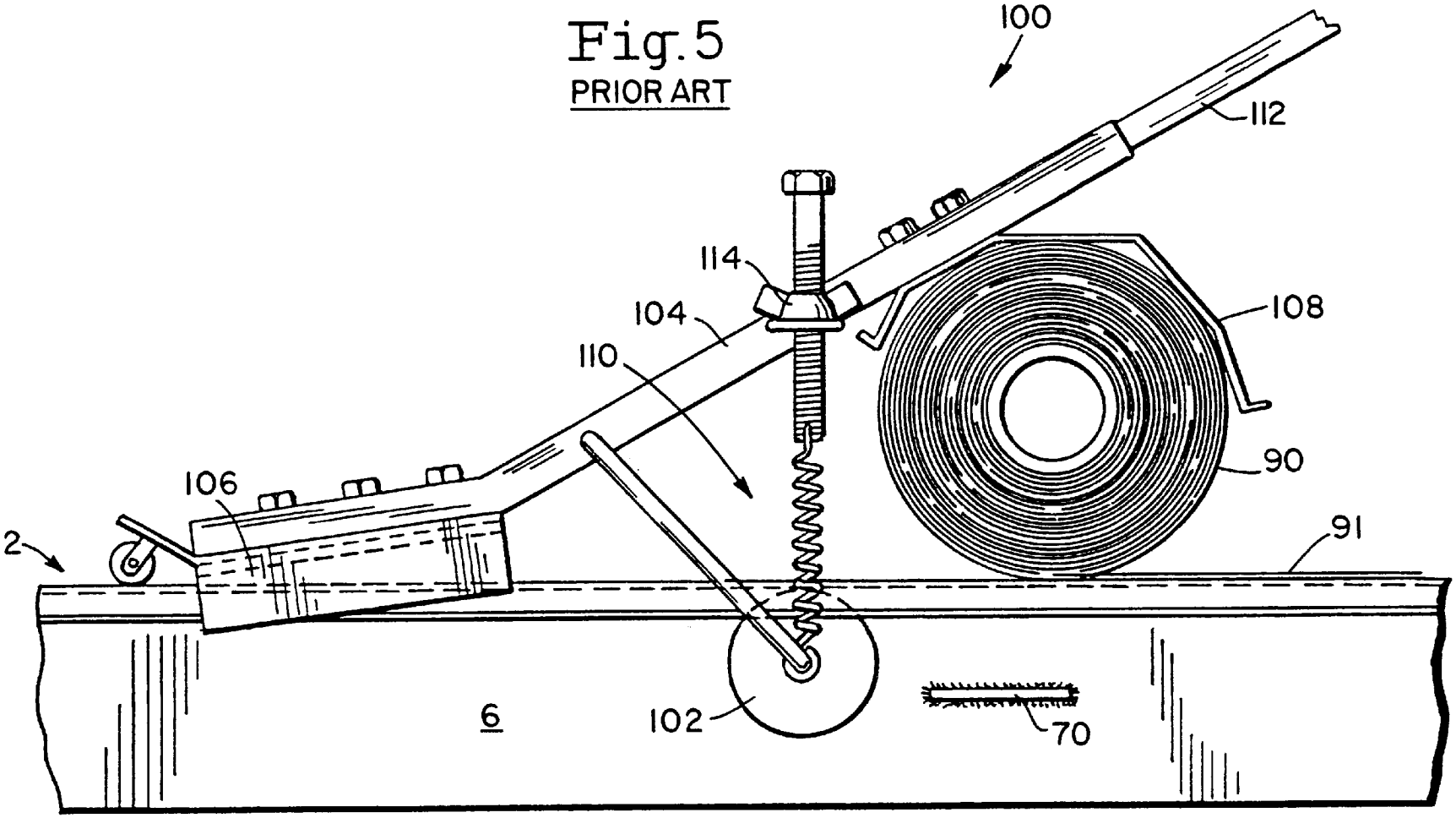
Fig. 5 PRIOR ART
FIG. 5 is a side plan view of a PRIOR ART device for dispensing fabric which may be used in the practice of this invention.

Specifically, in the practice of this invention, fabric sheet 91 is purposely not pulled taut as is done, for example, in U.S. Pat. Nos. 4,635,423 and 4,736,552, when sheet 91 is formed. Instead, it is draped to a preselected depth so as to create the aforesaid insulation cavity. This "depth of drape" may be achieved according to the methods of the subject invention by utilizing known dispensing devices or, alternatively, by dispensing by hand. One dispensing device which may be used is the PRIOR ART device illustrated in FIG. 5 and which is more fully described in commonly owned U.S. patent application Ser. No. 09/392,716 filed Sep. 9, 1999 and entitled ROOF FABRIC DISPENSING SYSTEM, now U.S. Pat. No. 6,247,288. FIG. 5 illustrates the prior art technique of pulling fabric sheet 91 taut during dispensing, which then results in the undesirable compression of fiberglass batting laid thereon, by the metal roofing sheets 94 when installed. By adjustment of the biasing mechanism, however, and proper manual dispensing using this device, the appropriate insulation cavity can be formed. In this respect, dispenser 100 includes frame member 104, guide 106 for embracing the top flange of purlin 6 with a minimum amount of friction, engagement means 108 for securing a roll of fabric 90 against the upper surface of purlins 6, and a tensioning device 110 which secures the entire device 100 against the roof structure indicated at 2 and which, through adjustment according to the teachings of this invention, may be used to create the requisite sag and depth of drape as aforedescribed. Further illustrated in FIG. 5 is push pole 112, shown inserted in frame member 104, which may be used to push the dispenser 100 during the installing of rolled fabric 90. For convenience, only purlin 6 and cross support member 70 are shown.

Figure 6:
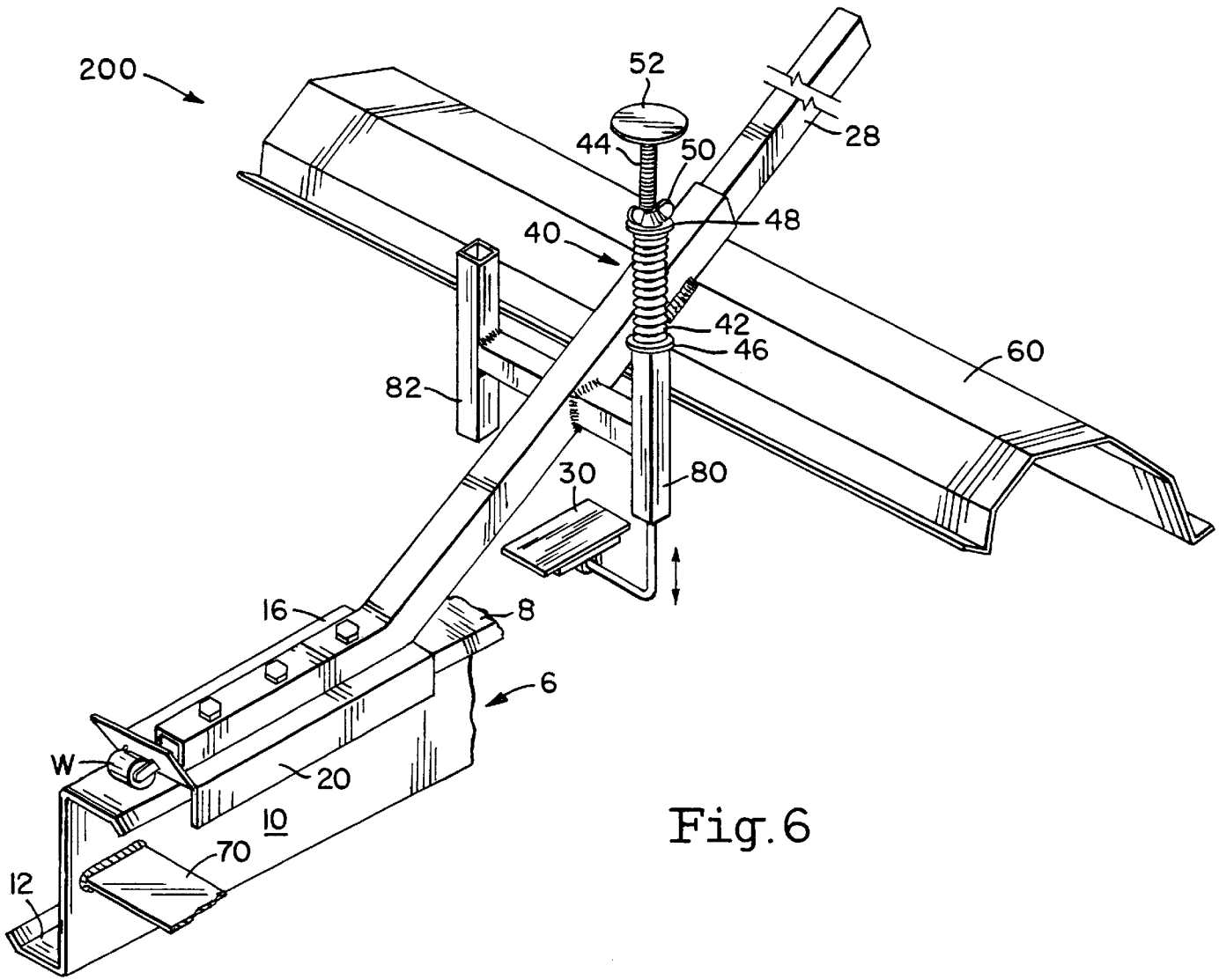
FIG. 6 is a side plan view of a particularly preferred dispensing device for carrying out this invention.

As another example of a dispensing device which may be used to practice this invention, and, indeed, as a particularly preferred device in this regard, there is disclosed in my commonly owned U.S. Patent Application entitled ROLLED FABRIC DISPENSING APPARATUS concurrently filed herewith, a unique dispensing apparatus for this purpose, an embodiment of which is illustrated as device 200 in FIG. 6 herewith. Device 200 is illustrated in FIG. 1, dispensing fabric 90 according to this invention.

With reference to FIGS. 1 and 6, dispenser 200 includes a frame member indicated at 14, a guide member 16 for tracking along purlins 6 while providing a low friction contact surface, a rolled fabric engagement mechanism 60 for holding a roll of fabric 90 securely in place against the surface of purlins 6, and a biasing mechanism 40 which works to bias a glide mechanism 30 against the undersurface of purlin top flange 8. Additionally provided is push pole 28, shown inserted in an end of frame member 14, which is generally used as a means for pushing the dispenser 200 along the length of purlins 6. Push pole 28 may be supplemented, if desired, at its connection with member 14 by an insert (not shown) which angles pole 28 so that pole 28 extends substantially parallel to purlins 6 and is, at its push end, about waist high to an average worker.

Provided on dispenser 200 is a low profile glide mechanism 30 which renders dispenser 200 capable of dispensing along the full length of a purlin 6 without the need for removal upon encountering a cross support member 70. This is because glide mechanism 30, usually a Teflon or nylon plate (or, alternatively a series of small diameter wheels having a common axle, and not shown here for convenience), is of a sufficiently low profile (i.e., limited height) such that when the presence of a purlin cross support member 70 is encountered during dispensing, glide mechanism 30 is able to pass unencumbered between the upper surface of cross support member 70 and the lower (i.e., under) surface of purlin top horizontal flange 8 (i.e., through the glide space or path) without obstruction. Dispenser 200 may also be provided with a roller wheel W, as shown, or alternatively may have the forward end of member 14 hinged to guide plate 20 (not shown for convenience) rather than bolted to it (as shown) so as to maintain plate 20 flush with surface 8 during dispensing.

Further provided on dispenser 200 is biasing mechanism 40 which affords the significant advantage and unique ability to permit the dispenser 200 to be quickly attached and detached from the purlins 6. Its adjustable feature also enables an easy and effective way of creating the drape or sag during installation. Generally speaking, biasing mechanism 40 includes a spring 42 with a partially threaded rod 44 inserted therethrough and a washer 46 inserted upon rod 44. Washer 46, when biasing mechanism 40 is assembled, abuts the surface of the upper end of the tubular opening of arm 80 providing a lower biasing surface for spring 42. Located at the opposite end of spring 42, disposed about rod 44, is washer 48. Washer 48 is adjustably securable against the force of spring 42 via threaded wing nut 50 which serves to either compress or permit decompression of spring 42 as it is threaded up or down rod 44. Located at the uppermost end of rod 44 is push plate 52 which is removably attached to rod 44 via a threaded opening for receipt of the complementarily threaded upper end of rod 44. Thus, by merely depressing push plate 52 with one's hand, for example, thereby compressing spring 42 and releasing the pressure of glide mechanism 30 against the underside of flange 8, the entire apparatus may be easily removed from purlin 6 without need for disassembly. Using this same process, dispenser 200 may be easily installed for use on purlin 6. Moreover, by adjusting the amount of compression in spring 42, roll 90 is held more loosely or tighter to the purlins' surfaces, thus creating more or less sag in sheet 91 during dispensing.

Still further provided on dispenser 200 are two arms 80 and 82, through which biasing mechanism 40 may be alternatively assembled. This capability provides the distinct advantage of permitting dispenser 200 to be adapted to dispense along a purlin 6 regardless of the orientation (right or left in relation to the direction of dispensing) of its top horizontal flange 8. Thus, depending upon the orientation o f the top horizontal flange 8 encountered, biasing mechanism 40 may be assembled through either of arms 80 or 82 such that glide mechanism 30 will be appropriately oriented to engage with the under-surface of the respective top horizontal flange 8.

Turning no w to FIGS. 2–7, the creation of an appropriate "depth of drape" is both illustrated and determinable therefrom by the skilled artisan using only routine calculations and, at times, initial, simple, experimentation on the job site. For example, if the fiberglass batting 92 to be installed is to have a nominal R-13 value, the fiberglass batt is normally manufactured to a thickness of about 4 inches. This, then, generally determines the depth of drape to be designed into the system. In this respect, and as shown in FIG. 3, in practice, the drape configuration achieved in most situations may be deemed reasonably rectangular in shape with its lower corners being arcuate in nature. As shown in FIG. 4 for shallower depths of drape, the sag becomes more arcuate and less rectangular. In either event the desired depth of drape should be achieved over a substantial width of the cavity so as to maximize the approximation of the theoretical, preselected R-value.

It is further understood that, while it is within the scope of this invention to lay the fiberglass batts lengthwise in the cavity, i.e., parallel the purlins, in the preferred embodiments the batts extend perpendicular the purlins, as illustrated by batt 92 in FIG. 1. In this configuration, while compression does occur above the purlins and to an increasing extent as the batt approaches each purlin, a continuous insulation layer is achieved. When the batts are laid longitudinally within the cavity, parallel to the purlins, gaps in the insulation layer near the purlins (and above the purlins), may occur.

To achieve the requisite depth of drape, thereby to approximate, in an economically feasible way, the theoretical R-value of the insulation chosen for use, the following technique has been found efficacious to use. First, it is to be recognized, as illustrated in FIGS. 2–4 that the depth of drape "x" varies in a somewhat semi-arcuate manner from zero at the top surface of purlins 6 to a maximum "$x_1$" depth. This is true whether there are no cross-members, or as shown in FIG. 3, a cross member 70 interferes at some point to raise a small portion of fabric sheet 91 above the maximum "$x_1$." In this respect, for most situations experienced, and with regard to determining the width of sheet to employ and the depth of drape to achieve, the distance "y" can be assumed to be equal to or greater than "$x_1$." It has been found that for most situations cross members 70 are sufficiently small and are located sufficiently low enough on web 10 that their effect is negligible. Of course, if when determining the width of sheet (as described below) a more sophisticated calculation may be used or a larger safety factor employed to take this obstructing cross member into account.

Figure 7:
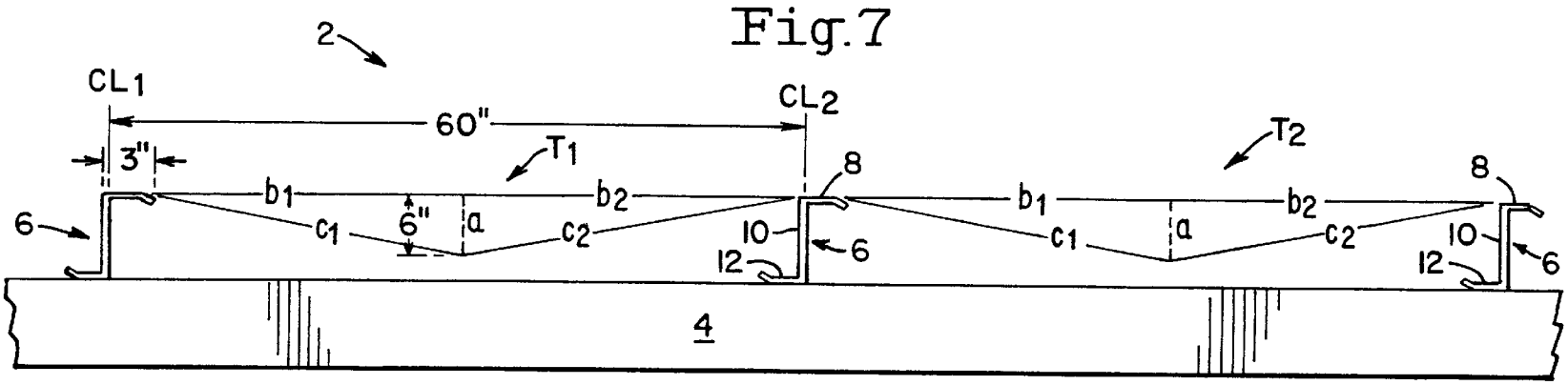
FIG. 7 is a schematic illustration which may be employed in the practice of this invention to determine an appropriate depth of drape.

With reference now to FIGS. 4 and 7 an appropriate width of fabric 91 may be determined to achieve a given depth of drape. In this respect, it is desirable to initially determine the appropriate size (i.e., width) of rolled fabric 90 for installation on the roof structure 2 which will give the desired depth of drape to the cavity with a minimized amount of wasted fabric. Although a specifically sized roll of fabric 90 need not be used to practice within the scope of the subject invention, fabric of a specific width may be used for aesthetic and/or efficiency purposes. In particular, when certain widths of rolls are utilized in the installation process, fabric waste can be reduced and/or aesthetic appearance can be improved while assuring that the appropriate depth of drape and a continuous vapor barrier protection is achieved.

For example, if the total width of fabric 90 necessary to allow for coverage over the top of the spanned horizontal flanges 8 (while still achieving the desired depth of drape) is, for example, 130 inches, then any width greater than 130 inches is potentially wasted fabric. In addition, if substantial excess fabric width is present, the extra fabric, in reality, must be overlapped with the next continuous sheet edge in a manner such that it is not exposed or hanging from the underside of roof structure 2 (i.e., the interior of the building) or trimmed off, for aesthetic reasons.

When determining the appropriate width of a sheet (roll) to be used, then, the first step is to select a desired R-value and corresponding depth of drape for the particular roof structure design that is to be insulated. For example, if the R-value selected is R-19, normally a glass fiber batting of this R-value will have a thickness of about 6 inches. The depth of drape will then be chosen accordingly to be 6 inches or, if desired, somewhat more (e.g., 7 inches) to minimize the amount of fiberglass compressed. Once the depth of drape is selected, and knowing the roof structure dimensions, the calculation of sheet width becomes purely mathematical. While such a calculation can be very sophisticated, taking very precisely into account the location of cross-members 70, the arcuate nature of the cavities' cross-sectional shape, etc., the following technique has been found quite adequate to achieve a good approximation of the width of a sheet to achieve the intended R-value while also assuring the achievement of a continuous vapor barrier as the first layer in the stack, and a minimized excess (if any) of fabric that must be trimmed.

Referencing in particular FIG. 7, a simple technique for calculating sheet width may be easily demonstrated. Here, three purlins 6 are schematically shown as part of a typical roof structure with no obstructing cross members 70 (e.g., either there are no cross members or "y" is assumed to be equal to or greater than "$x_1$"). To place some typical dimensions on the system for exemplar purposes, the centerline $CL_1$ to centerlines $CL_2$, i.e., the spacing between purlins from the centerline of the top surface of flanges 8, is 60 inches, with each purlin flange 8 being 3 inches wide (thus $CL_1$ and $CL_2$ are located 1.5 inches from each flange edge). To install fabric 90 across the width of these three purlins from a single roll, while achieving a depth of drape of approximately six inches, a triangular configuration for each cavity is assumed (FIG. 7) and is designated as $T_1$ and $T_2$, respectively. Each triangle between the purlins (starting at the edges and not the centerlines of purlin flanges 8) is bisected by a vertical line "a" representing "$x_1$", in this instance, the desired 6 inches depth of drape to be achieved. The length of each line $b_1$ and $b_2$ are equal and are ½ the actual space between the inner edges of the opposing pair of purlins (i.e., $$\left(\frac{60'' - 3''}{2}\right)$$

which in this example is 28.5 inches given that the two centerlines $CL_1$ and $CL_2$ are 60 inches apart and each purlin's upper flange 8 is 3 inches wide. The dimension "a" is the selected depth of drape, and in this example is selected as 6 inches. Thus, where a=6 and b=28.5, c will equal the square root of $6^2+28.5^2$ or, in this example approximately 29 inches.

The span length for the theorized sheet is then 4×C, and thus 4 times 29 inches, or 116 inches, which assumes no fabric located on any of the three flanges 8. This assumption must be taken into account as well as the fact as shown in FIGS. 3–4 that the actual drape is not a straight line, but a somewhat longer arcuate configuration. In this respect, it has been found that the final calculated width should further include the additional flange lengths (here 3 flanges times 3 inches) and an additional 3–5 inches or more of fabric added for each cavity (here two cavities in FIG. 7) as a safety factor to assure a continuous vapor barrier while achieving the approximate depth of drape desired. Thus in this example, fabric sheet (roll) width should be 116 inches+9 inches+6–10 inches, which equals 131"–135."

Given this width of fabric, there may well occur some excess fabric after sheeting 94 is secured in place. In one technique useful in the practice of either FIG. 7, or with a properly calculated width for the roll in FIG. 1, no excess will extend into the building. For example, in FIG. 1, roll 90 is centered so that no excess exists at peak "P" (i.e., the edge of sheet 91 is secured by adhesive and aligned along the peak flange with no excess when dispensed). Any excess after the five cavities are formed to a depth of drape will exist at eave "E" and is easily trimmed off. The situation where multiple adjacent rolls are used is described below.

As the skilled artisan will appreciate, in this respect, each job will dictate to the skilled artisan the best safety factor to employ, using the above as a guide, to assure the requisite depth of drape and a continuous vapor barrier. While the amount of excess fabric is to be maintained at a minimum, the achievement of the requisite depth of drape without pulling the vapor barrier sheet from off the purlin flange (thereby breaking the vapor barrier) dictates the use of a safety factor in favor of excess. Due to the nature of this invention, the trim step is rather easy and minimal in expense.

Achieving the desired depth of drape according to this invention may be accomplished manually, or preferably using the dispensers shown in FIGS. 5 or 6 (the dispenser of FIG. 6 being preferred if cross members such as 70 are present in the structure). FIG. 1 illustrates one way of doing this. As stated above, and as described below, roll 90 in FIG. 1 has been advanced more than the normal distance, for better viewing here.

With reference then, generally, to FIG. 1, roll 90 and dispenser 100 are first placed at the end "A" of roof structure 2 to start the process. End A, like its opposite end "B" is provided with a reversed "L" shaped rake angle 7. The starting lateral edge of sheet 91 is then secured (e.g., using a double sided adhesive tape) to the top surface of rake angle 7A (at end A). Assuming an appropriately calculated width for sheet 91 (with an adequate safety factor as aforesaid), the upper surface "T" of the purlin at the roof peak "P" may be provided with an adhesive (e.g., double adhesive tape) and roll 90 aligned so that its peak side edge (i.e., the upper edge of sheet 91) is adhered to upper surface "T" without any excess that could be seen from inside the building. All excess, if any, that occurs, will occur at eave "E" where it can be easily trimmed. While the top of purlin 6 at eave "E" may also be provided with adhesive, thereby adhering sheet 91 thereto, such as in windy conditions, it is preferred that this lower edge of sheet 91 be unconstrained so as to aid in the sagging process, and particularly to take into account any substantial inaccuracy in the calculation of the sheet width.

After securing the first end of sheet 91 to rake angle 7A, roll 90 is advanced far enough to allow batting 92 to be rolled out into place. In this respect, as aforesaid, FIG. 1 exaggerates the distance roll 90 is initially advanced. In practice, if batting 92 has a width of 4–5 feet, roll 90 is advanced only about 6 feet presenting a nontaut sheet 91 across the initial spanned distance. In certain instances the sag will immediately, or at least partially form. Batt 92 is then rolled out across the draped sheet, the weight of batt 92 usually being sufficient to create the depth of drape desired. If the depth of drape is incorrect, roll 90 can be rotated manually to create more or less tension in it.

Before constructing the next section, wing nut 50 (FIG. 6) will be manipulated to adjust the spring tension for more or less slack, as desired, until the desired depth of drape is achieved. Thereafter, metal roof covering sheet (panel) 94 is placed over the top of batt 92. The sag (depth of drape) is again checked and readjusted if necessary. Once the appropriate depth of drape is achieved in all cavities, sheet 95 is secured (e.g., by screws) to the purlin flanges in a conventional way, thereby securing the entire layer stack to the purlins, including that portion of the eave edge of sheet 91 under the sheeting, but leaving the uncovered portion of the edge unconstrained for movement.

Standing on first sheet 94 when secured, the operator now advances dispenser 100 (FIG. 1) another section distance, e.g., six feet and the process of laying the next batt and roll sheet is repeated, adjusting again if necessary the roll or its slackness by changing the tension on the roll by using the wing nut. In this respect, it has been found that after one or two adjustments (i.e., one or two sections are formed) a skilled operator using the leverage available to him via arm 112 or 28 can easily supplement (one way or the other) the biasing force of spring 42 (or the spring in FIG. 5) so that a uniform desired depth of drape is quickly achieved with little or no adjustment needed thereafter. The depth of drape, in this respect, can be initially measured, and continuously or randomly monitored using a conventional pin gauge.

In another alternative embodiment of the subject invention, in which multiple widths (i.e., rolls) of fabric 90 are simultaneously installed on roof structure 2, the rolls of fabric 90 may be installed in a staggered fashion in order to ensure that only one edge of any given roll need be aligned with a purlin or bar joist. This provides a distinct advantage over prior art techniques which require aligning both edges of each fabric roll 90 with a purlin or bar joist to prevent excess fabric from extending into the building.

Figure 8:
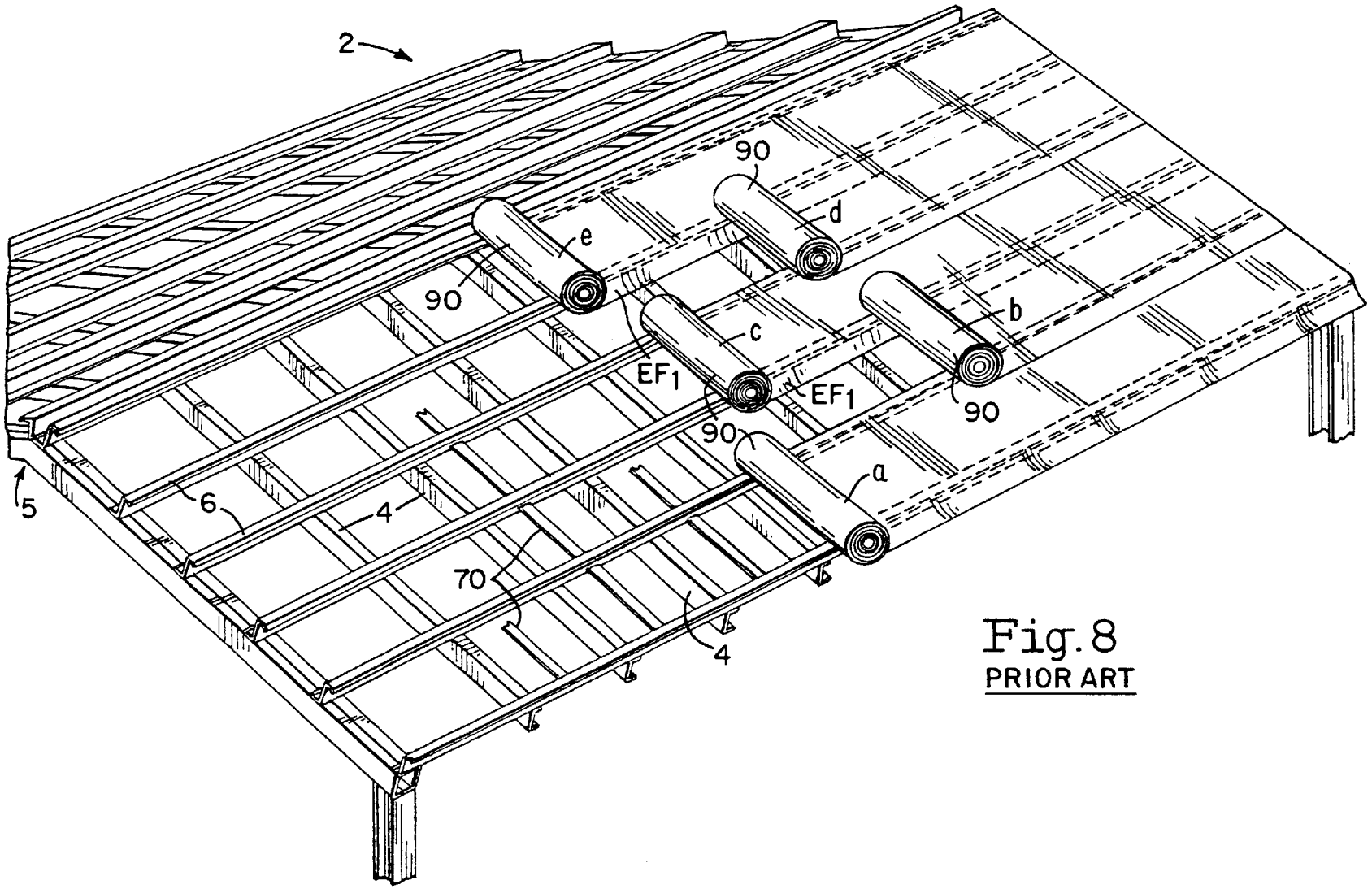
Fig. 8 PRIOR ART
FIG. 8 is a three dimensional, partial view of a prior art technique for laying down multiple rolls of fabric on a roof structure.

In a typical prior art technique illustrated in FIG. 8, as one progresses or counts the rolls of fabric 90 from the eave of the roof structure 2 to the roof peak 5, the first roll "a" is advanced farther than the second roll and stays ahead of the second roll "b" throughout the dispensing process. Typically, in such a process the sheet is pulled tight so as to present as little sag as possible between purlins. The edges were then, at times secured by adhesive to the purlins.

The front roll for purposes of this explanation is hereby defined as a lead roll and each roll following (dispensing behind) a lead roll is hereby defined as a trailing roll. The third roll ("c") is advanced substantially even with the first roll (thus ahead of the second roll) and the fourth roll ("d") is advanced at substantially the same rate as the second roll (thus behind the third roll). This pattern continues in the technique of the prior art with each successive roll (a–e) alternating in position (from lead to trailing) in like fashion.

In this known technique, each edge or end of each leading roll of fabric 90 must be aligned with a purlin or bar joist because if this is not done, as can be seen, excess fabric indicated as $EF_1$ will hang from the underside of the roof structure 2 (from a purlin or bar joist) and into the interior of the building. This excess fabric must thereafter be trimmed (or otherwise dealt with) or an insulated roof structure with an undesirable appearance will be obtained.

Figure 9:
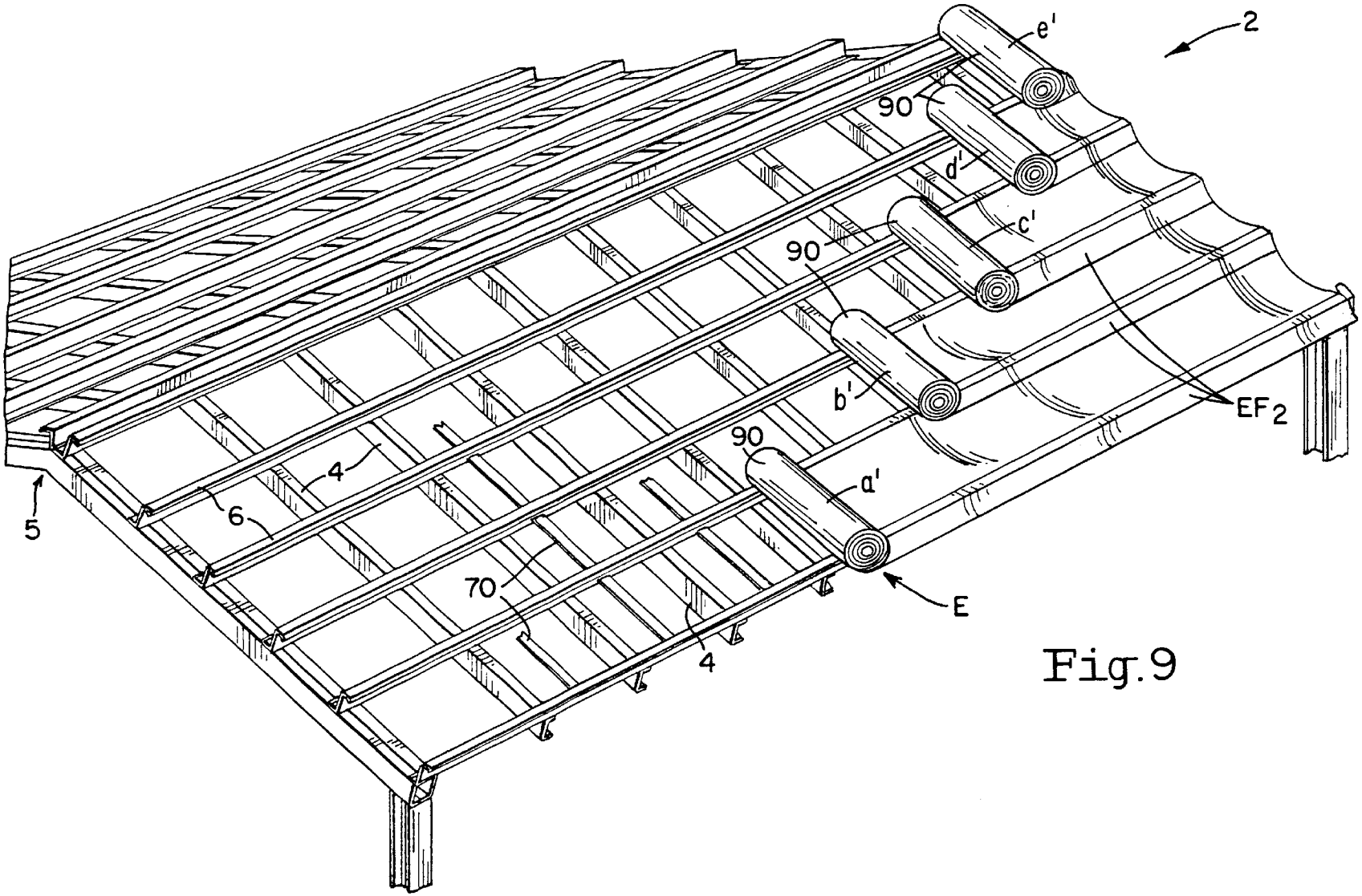
FIG. 9 is a three dimensional partial view of a technique for laying down multiple rolls of fabric on a roof structure according to this invention.

This problem is overcome by a unique technique according to this invention, an embodiment of which is illustrated in FIG. 9. With reference thereto, and counting again from one side of the roof structure 2 to the roof peak 5, each fabric roll 90 (except the first roll) is made to follow or trail the leading roll immediately preceding it. For example, roll b' trails roll a' and roll c' trails both rolls a' and b'. Further, roll d' trails all other rolls, a', b', and c'. Roll e' trails in like manner. This pattern is continued for each successive roll being installed on the roof structure 2, i.e., each successive roll trails all others. It is understood in this respect that FIG. 9 is diagrammatic for illustrative purpose, and that in actual practice the longitudinal spacing between staged rolls (a'–e') will be much less while, of course, still maintaining the lead roll concept as shown. Moreover, in actual practice, each roll will generally span more than two opposing purlins, thereby to create with a single roll at least two insulation cavities. Again, however, the illustrated lead roll concept is maintained. A benefit of wider rolls, in this respect, is to reduce the number of seams created.

Utilizing this unique technique, only one edge (i.e., end) of each roll of fabric 90 need be aligned with a purlin or bar joist, thus solving the above-described problem of the prior art. As long as the end of each roll of fabric 90, which is located opposite the end of that of the preceding leading roll (e.g., on the end toward the roof peak 5 in the illustrated embodiment), is aligned with a purlin or bar joist, excess fabric will never hang within the building interior at the underside of the insulated roof structure 2. This is because, as can be seen any excess $EF_2$ will always be located atop the edge of the fabric dispensed by the preceding roll and aligned with the purlin until the last roll in the chain which can be located at the eave of the roof and excess $EF_2$ easily trimmed.

In such an embodiment, two significant advantages accrue in addition to having no excess extending into the building. First, as stated above, trimming need be done, only at one location, depending on the start of the stagger, e.g., in FIG. 9 only at the eave "E", which is easily accomplished. Of course if roll a' is made to precisely align with its two purlins after the insulating cavity is formed, trimming is avoided altogether. Second, because there is no concern over excess fabric draping into the building and trimming is easily accomplished at the eve "E", an additional safety factor can be built into the rolls' widths, up to a 12" or more, to be sure that a continuous vapor barrier is achieved when obtaining the maximum volume of cavity at a depth of drape of $X_1$. Of course, in this embodiment, one edge (e.g., the aligned edge) of each sheet may be adhered to its respective purlin (e.g., by double-sided adhesive tape), leaving the other edge (e.g., the excess edge) free to shift (slide) inwardly to form the insulation cavity.

As an aid to keeping a roll in alignment, roll adjuster 210 (FIG. 11) may be employed to straighten the alignment of a roll of fabric 90 with respect to the purlins 6, when necessary. Roll adjuster 210 generally comprises a roll adjuster handle 212 and a roll engagement end 214 for communicating with a roll of fabric 90. The roll engagement end 214 may optionally include rollers 216 for contact with a roll of fabric 90. When a roll of fabric 90 needs to be straightened with respect to the purlins 6 of the roof structure 2, an installer may employ roll adjuster 210 to push the roll of fabric 90 back into alignment (substantially perpendicular to purlins 6). This is accomplished by using handle 212 to apply a force to an end of the roll of fabric 90 via the roll engagement and 214 of the roll adjusting device.

As can be seen from the above, a depth of drape can be accomplished in many ways. For example, in a still further embodiment of the subject invention, a depth of drape may be formed, cavity by cavity, by securing fabric 90 as it is rolled out on purlins 6 with spot tape or other suitable means as each cavity is formed and before the insulation batt is applied. This can be done using the above-described equipment, or manually if desired. For efficiency, however, the multiple cavity approach disclosed above is preferred.

This invention is not limited to installing fabric on roof structures or constructing such structures. It may also be used to create a similar insulated layer stack with a predetermined depth of drape in a vertical wall structure such as is illustrated in FIG. 11. With reference thereto, it can be seen that the same basic method is employed when constructing a wall structure 303 as was employed for constructing roof structure 2, except for a few modifications as noted below.

Wall structure 303 typically includes a series of vertical structural studs (columns) 301. Studs 301 are analogous to rafters 4 in roof structure 2, and are similarly set in a parallel arrangement one to the other. Perpendicularly arranged with respect to studs 301 and connected thereto are purlins 6', generally of the same type as are used in roof structure 2 and thus, once again, forming opposing pairs of purlins (girts) between which an insulation cavity according to this invention can be formed.

Further illustrated are completed roof structure 311 and ground level 309. Rake angles 313 at the corners of the structure may be employed. In this respect, it is understood that only one wall of the building is being shown, and that in the typical situation (other than an open ended shed) a similar wall structure located in the direction of the arrows at 303' would be constructed (not shown for convenience). Moreover, in FIG. 11, the roof structure is illustrated as a flat (i.e., horizontal) roof without a peak. If a peak roof is present at wall 303', the insulation of its peak (triangular) area would be accommodated manually according to this invention, creating where feasible a depth of drape.

Wall structure 303 in this embodiment is of a sufficiently low height so that a single roll 90' of vapor barrier fabric will cover the entire vertical width (span). This enables a simple roller mechanism, e.g., a roller ball 307 with axle 315 extending into the tube (core) on which fabric 90 is rolled, to be used to advance roll 90 horizontally using dispenser 200 along the ground 309. Generally speaking, the same general staged construction steps are employed as in constructing roof structure 2 as described above except that, here, gravity is not in the precise direction of sag. For this and other apparent reasons, the uppermost purlin (or eave structure) **6*u*' is preferably provided with adhesive, such as a strip of double sided adhesive tape 317, while leaving unconstrained the bottom edge of the sheet, with the excess fabric draped on ground level 309. Sheet 91' is thus left in an untaut condition whose loose edge is free to move to accommodate the formation of the six insulation cavities which will be formed in wall 303**.

As illustrated in FIG. 11, the appropriate width of roll 90' (sheet 91') has been calculated as aforesaid. Here, of course, the lowermost purlin 61' is attached to columns 301 high enough on the columns so that roll 90' and sheet 91' can extend beyond purlin 61' toward ground level 309. This allows the upper edge of sheet 91' to be aligned with the upper edge of purlin **6*u*' without excess fabric extending into the building when secured by the adhesive to the outer surface of purlin 6*u*'**. Excess fabric "EX" if any, will then exist only at the bottom outside of the building where it can be easily trimmed.

In the instance of a wall construction as opposed to a roof where it would create an unsafe condition, the entire sheet may theoretically be laid out before any insulation is applied. In windy situations this can be difficult, and in preferred embodiments, wall structure 303 is constructed in stages similar to roof structure 2. For example, in a first step, after adhesive strip 317 is put in place, roll 90' is placed on roller 307 and vertically aligned with the starting end of wall 303 and its upper edge with purlin (or girt) **6*u*'. Dispenser 200 is then placed on the roll, which is advanced a short distance, e.g., 5–7 feet to "hang" an initial section of sheet whose upper edge when dispensed is held on purlin 6*u*' without excess fabric by adhesive tape 317. Next, a batt of fiberglass 92 (not shown in FIG. 11, but like that of FIG. 1) is unrolled and tack or screw secured ("hung") at its upper end to purlin 6*u*'**.

To achieve the requisite depth of drape at this point, the worker may use optimal techniques given that all excess fabric now either hangs in an untaut manner between the purlins to ground level 309 below purlin 61'. If desired, the workers may now push the batting inward to form each cavity by hand, allowing the fabric sheet to shift to accommodate the sag. This can be done with a preform member having a generally "U" shape, rather than by hand if desired. At this point dispenser 200's spring may be adjusted and/or roll 90 turned, if needed, to aid in accomplishing the desired depth of drape here and for the next section. In this option, excess batting and fabric existing exclusively at the floor level, may be conveniently trimmed, before metal (or plastic) wall covering is applied.

In an alternative option, the "hung" fabric need not be pushed into the wall structure by hand. Rather, in certain instances, the application of the hard covering sheet of metal (or plastic such as PVC siding) and securing it to the purlins will itself accomplish the task of creating the cavities as desired when proper slack is present. In such an instance, the need to properly adjust the dispenser's tension and amount of horizontal untautness to be sure that all cavities form reasonably uniformly depths of drape must be carefully observed, and slightly adjusted by hand if necessary.

In either alternative, once the first section of the insulated wall stack is secured to the purlins, dispenser 200 is advanced another section width and the process repeated until the wall is completed. The corners of the building are then capped off in a conventional manner. If desired another strip of adhesive, once all cavities are formed, may be placed on side surface 319 of rake angle 313 to finally secure the finishing end of sheet 91 before the last piece of cover sheeting is put in place.

As an aid to maintaining the roll straight, when advancing the roll along wall 303, or simply holding it in place during the construction of the sections of wall, element 210 (FIG. 10) via handle 212 and roll engaging means 214–216, may be employed to supplement the dispenser (e.g., dispenser 200). Moreover, in certain embodiments, wall heights may not permit the use of a single roll and thus multiple rolls will be needed. This invention enables such a construction because it merely necessitates the use of scaffolding, for example, to unroll any roll 90 elevated above ground level (e.g., imagining FIG. 9 to be a vertical wall instead of a sloped roof 2, with scaffolding employed to unroll each fabric roll above ground height along at its given elevated position). Thus by using once again the "leading roll" concept of overlap as described above to construct such a wall, excess fabric appearing on the inside of the building is avoided, and will only appear at the ground level where it is easily trimmed.

Once given the above disclosure many other features, modifications and improvements will become apparent to the skilled artisan. Such other features, modifications, and improvements are, therefore, considered a part of this invention, the scope of which is to be determined by the following claims.

I claim:

1. In the method of constructing an insulated roof or wall system which includes at least three consecutive, spaced, substantially parallel structural members having spaces therebetween and a longitudinal surface for receiving thereon a sheet of vapor barrier material for retaining insulation within said spaces, the steps comprising; applying said sheet of vapor barrier material across said at least three spaced structural members, applying a layer of compressible and recoverable insulation having a predetermined thickness which at least in part determines the R-value of the insulation located over the sheet of vapor barrier material, and applying a cover material over the layer of insulation, the improvement comprising the steps of:

a) overlaying the longitudinal surfaces of said at least three spaced structural members with an untaut sheet of vapor barrier material having an untaut width sufficient to allow the formation therewith of an insulation cavity within said spaces between said structural members to a depth of drape sufficient such that when the insulation layer resides in the cavity a substantial portion of the insulation has a thickness approximately equal to the said predetermined thickness;

b) overlaying the untaut sheet of vapor barrier material with a layer of said insulation;

c) forming the insulation cavity to said depth of drape, wherein a portion of said insulation is located in said cavity;

d) overlaying said insulation with a covering material; and e) forming a structurally integrated roof or wall system by securing said vapor barrier sheet, said insulation, and said covering material to each other and to said structural members, whereby a substantial portion of said insulation in said cavity has a thickness approximately equal to said predetermined thickness.

2. A method according to claim 1 wherein said structural members are part of a roof of a metal building structure.

3. A method according to claim 1, which further includes the steps of predetermining the width of said sheet of vapor barrier material which is needed to span said at least three consecutive, spaced, substantially parallel structural members, and thereafter using as said sheet, a sheet of said predetermined width.

4. A method according to claim 1, wherein said step of overlaying the longitudinal surfaces of said structural members with said untaut sheet of vapor barrier material includes adhesively securing at least one of the edges of said untaut sheet to said longitudinal surface of a said structural member.

5. A method according to claim 4, wherein the edge of said sheet opposite said adhesively secured edge of said sheet extends beyond a respective structural member over which it is laid as excess material.

6. A method according to claim 5, in which said edge of said sheet which forms said excess material is unadhered to said structural member over which it is laid prior to the formation of an insulation cavity, and wherein the step of forming said insulation cavity includes moving said unadhered edge of said sheet of vapor barrier material toward the cavity as said cavity is being formed.

7. A method of constructing an insulated wall or roof structure of a building which includes a plurality of spaced opposing pairs of substantially parallel structural members between which is to be located a compressible insulating material having a predetermined thickness which represents the R-value of said insulation and an underlying sheet of a vapor barrier material, the steps comprising:

a) providing at least two rolls of vapor barrier material, each roll being wider than the distance between a pair of spaced opposing structural members, b) locating a first roll with respect to said roof structure so as to span the distance between at least one pair of opposing structural members in such a manner that a first edge of the first roll is aligned with its respective structural member so as to leave no excess of material there over and so that a second edge of the first roll opposite said first edge extends beyond its respective underlying structural member thereby to form an excess of vapor barrier material therebeyond, c) advancing said first roll a distance sufficient along its respective structural members to locate said first edge on its respective structural member without excess material and said second edge on its respective structural member with excess material extending therebeyond, d) locating adjacent but behind said first roll, a second roll of said material having a second edge of excess material which overlays said first edge of said first roll and having a first edge aligned without excess material with an opposing structural member, e) advancing said first roll ahead of said second roll to cover the distance between said plurality of spaced pairs of structural members in such a manner that said first roll remains the lead roll as both rolls are advanced such that the excess material located at said second edge of said second roll overlays the first edge of the first roll when said rolls are advanced, thereby forming a continuous vapor barrier layer, and f) thereafter, applying a layer of insulating material over said vapor barrier layer.

8. A method according to claim 7 wherein said first and said second rolls are advanced in a nontaut manner, and wherein said method further includes the step of forming an insulation cavity with said nontaut vapor barrier material.

9. A method according to claim 8 wherein said insulation cavity has located therein said insulation material and has a maximum depth of drape approximately equal to said predetermined thickness of said insulation material.

10. A method according to claim 7 or 9 wherein said structural members comprise the roof structure of said building which includes an eave side edge, wherein the excess material located at said second edge of said second roll hangs over said eave, and wherein no excess material located at any edge of any roll hangs into said building.

11. A method according to claim 10 wherein said method further includes the steps of applying a layer of covering material over said layer of insulation and thereafter securing said covering material to said insulation, said sheet of vapor barrier material and said structural members.

12. In the method of constructing an insulated vertical wall of a metal building structure which includes a pair of spaced substantially parallel structural members comprised of a longitudinal surface for receiving thereon a sheet of vapor barrier material, the steps comprising: applying a sheet of vapor barrier material across a pair of structural members comprising said vertical wall, applying a layer of compressible and recoverable insulation having a predetermined thickness which at least in part determines the R-value of the insulation located over the sheet of vapor barrier material, and applying a cover material over the layer of insulation, the improvement comprising the steps of:

a) overlaying the longitudinal surfaces of the pair of spaced structural members with an untaut sheet of vapor barrier material having an untaut width sufficient to allow the formation therewith of an insulation cavity between said pair of structural members to a depth of drape sufficient such that when the insulation layer resides in the cavity a substantial portion of the insulation has a thickness approximately equal to the said predetermined thickness;

b) overlaying the untaut sheet of vapor barrier material with a layer of said insulation;

c) forming the insulation cavity to said depth of drape, wherein a portion of said insulation is located in said cavity;

d) overlaying said insulation with a covering material; and e) forming a structurally integrated vertical wall system by securing said vapor barrier sheet, said insulation, and said covering material to each other and to said structural members, whereby a substantial portion of said insulation in said cavity has a thickness approximately equal to said predetermined thickness.

* * * * *

UNITED STATES PATENT AND TRADEMARK OFFICE

CERTIFICATE OF CORRECTION

PATENT NO. : 6,393,797 B1
DATED : May 28, 2002
INVENTOR(S) : Gary E. Romes

It is certified that error appears in the above-identified patent and that said Letters Patent is hereby corrected as shown below:

Column 5,
Line 28, delete “sage”, and insert -- sag --.

Column 7,
Lines 9-10, delete “o” and “f”, and insert -- of --.

Signed and Sealed this

Ninth Day of July, 2002

*Attest:*

*Attesting Officer*

JAMES E. ROGAN
*Director of the United States Patent and Trademark Office*